US005742691A

United States Patent [19]

Ambourn

[11] Patent Number: 5,742,691

[45] Date of Patent: Apr. 21, 1998

[54] SURROUND SOUND CONVERTER

[76] Inventor: Paul R. Ambourn, c/o Terry Montpetit 29 Scotch Pine Rd., North Oaks, Minn. 55127

[21] Appl. No.: 804,186

[22] Filed: Feb. 21, 1997

[51] Int. Cl.[6] ..... H04R 5/02

[52] U.S. Cl. ..... 381/24; 381/28; 381/18; 381/19

[58] Field of Search ..... 381/24, 17, 18, 381/19, 20, 28

[56] References Cited

U.S. PATENT DOCUMENTS

| | | | |
|---|---|---|---|
| 3,697,692 | 10/1972 | Hafler | 381/18 |
| 3,757,047 | 9/1973 | Ito et al. | 179/1 GQ |
| 4,204,092 | 5/1980 | Bruney | 179/1 G |
| 4,594,729 | 6/1986 | Weingartner | 381/18 |
| 5,109,416 | 4/1992 | Croft | 381/24 |
| 5,208,865 | 5/1993 | Friske et al. | 381/86 |
| 5,553,147 | 9/1996 | Pineau | 381/24 |

FOREIGN PATENT DOCUMENTS

| | | | |
|---|---|---|---|
| 2314634 | 10/1973 | Germany | 381/24 |
| 60-130300 | 7/1985 | Japan | 381/24 |
| 1454894 | 11/1976 | United Kingdom | 381/24 |

*Primary Examiner*—Sinh Tran
*Attorney, Agent, or Firm*—Donald J. Ersler

[57] ABSTRACT

A surround sound converter for home audio systems includes outputs for a left front speaker, a right front speaker, a left rear speaker, a right rear speaker, and an auxiliary output to accommodate a rear auxiliary amplifier. The surround sound converter also includes an input for the left and right channel speaker output of an amplifier, a receiver, or any stereo signal device which has an audio amplifier. At least one potentiometer controls the volume balance between the front and rear speakers. A left and right capacitor are used to drive the left and right rear speakers, respectively. An auxiliary output is provided to accommodate adding a rear auxiliary amplifier. A surround sound converter for vehicle audio systems utilizes an automotive stereo. A left front speaker and right front speaker are connected to the normal speaker outputs of the automotive stereo. The left rear speaker is connected to the left rear signal negative and the right rear signal negative. The right rear speaker is connected to the right rear signal positive and the left rear signal positive. This unique method of connecting the rear speakers produces a three dimensional surround sound image. The rear speakers can be amplified by adding a rear auxiliary amplifier.

5 Claims, 2 Drawing Sheets

SURROUND SOUND CONVERTER

BACKGROUND OF THE INVENTION

1. Field of the Invention

The present invention relates generally to surround sound processors and more specifically to a surround sound converter that is less complicated and more economical than that of the prior art.

2. Discussion of the Prior Art

Surround sound processors are normally used to decode surround sound audio signals which are recorded on the sound tracks of video cassettes and discs. Surround sound processors will also enhance the imaging of audio recordings. However, these surround sound processors use complicated circuitry to create a three dimensional sound field using five speakers, two front, one front center, and two rear. The five speakers create a three dimensional sound field similar to that found in a modern movie theater.

The prior art surround sound processors have complicated decoder circuitry which necessitates an expensive selling price. The prior art surround sound processors are either a three channel add-on unit which includes power amplifiers and which is used in conjunction with a stereo receiver, or a five channel stand alone unit which has power amplifiers for all five channels instead of three channels.

Accordingly, there is a clearly felt need in the art for a surround sound converter that has a less complicated design, an economical price, and which only needs four speakers to create a three dimensional sound field.

SUMMARY OF THE INVENTION

The primary objective of the present invention is to provide a surround sound converter that has a less complicated design, an economical price, and which only needs four speakers to create a three dimensional sound field.

According to the present invention, a surround sound converter for home audio systems includes outputs for a left front speaker, a right front speaker, a left rear speaker, a right rear speaker, and an auxiliary output to accommodate a rear auxiliary amplifier. The surround sound converter also includes an input for the left and right channel speaker outputs of an amplifier, a receiver, or any stereo signal device which has an audio amplifier. At least one potentiometer controls the volume balance between the front and rear speakers. One end of a left capacitor is connected to the right audio signal positive and the other end is used as a negative output terminal for the left rear speaker. One end of a right capacitor is connected to the left audio signal positive and the other end is used as a negative output terminal for the right rear speaker. An output potentiometer placed across either the left or right rear speaker output terminals is used as an auxiliary output for a rear auxiliary amplifier. The output terminal includes a negative output terminal and a positive output terminal.

A surround sound converter for vehicle audio systems utilizes an automotive stereo. The automotive stereo may be a radio, a radio/CD combination, a radio/cassette combination, or a radio/cassette/CD combination. A left front speaker and a right front speaker are connected to the normal front speaker outputs of the automotive stereo. The left rear speaker is connected to the left rear signal negative and the right rear signal negative. The right rear speaker is connected to the right rear signal positive and the left rear signal positive. This unique method of connecting the rear speakers produces a three dimensional surround sound image. The balance between the front and rear speakers is controlled by the automotive stereo fader. The rear speakers can also be further amplified by adding a rear auxiliary amplifier.

Accordingly, it is an object of the present invention to provide a surround sound converter that has less complicated decoding circuitry than that of the prior art.

It is a further object of the present invention to provide a surround sound converter that is less expensive than that of the prior art.

Finally it is another object of the present invention to provide a surround sound converter which has four speakers to produce the same sound as the five speakers required in the prior art surround sound processors.

These and additional objects, advantages, features and benefits of the present invention will become apparent from the following specification.

DETAILED DESCRIPTION OF THE PREFERRED EMBODIMENTS

Figure 1:
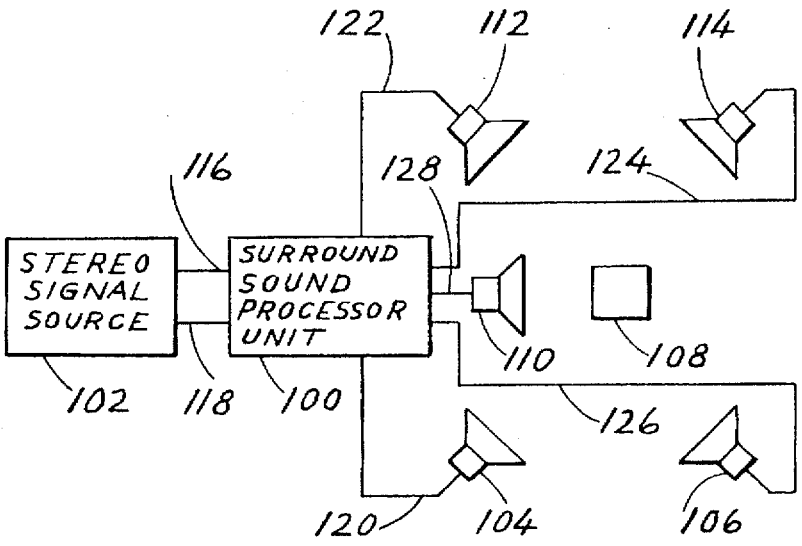
FIG. 1 (PRIOR ART)
FIG. 1 is a block diagram of a prior art five channel surround sound processor.

With reference now to the drawings, and particularly to FIG. 1, there is shown a prior art five channel stand alone surround sound processor unit 100. A stereo signal source 102 outputs a left audio signal 116 and a right audio signal 118 into a surround sound processor unit 100. The stereo signal source 102 can be a stereo VCR, a stereo receiver, a car stereo, or a stereo TV.

The surround sound processor unit 100 decodes and amplifies the left audio signal 116 and the right audio signal 118 into a three channel output. The five channel output comprises a left front speaker 112, a right front speaker 104, a center speaker 110, a left rear speaker 114, and a right rear speaker 106. A left front audio signal 122 is an amplified version of the left audio signal 116. A right front audio signal 120 is an amplified version of the right audio signal 118. An in-phase audio signal 128 is decoded from the left audio signal 116 and the right audio signal 118 and is output to the center channel speaker 104. A left out-of-phase audio signal 124 is decoded from the left audio signal 116 and the right audio signal 118 and is output to the left rear speaker 114 and the right rear channel 126. A right out-of-phase audio signal 126 is decoded from the right audio signal 118 and the right audio signal 118 and is output to the right rear speaker 106. A listener sits at a location 108 and hears a three dimensional sound field, similar to that in a modern movie theater.

Figure 2:
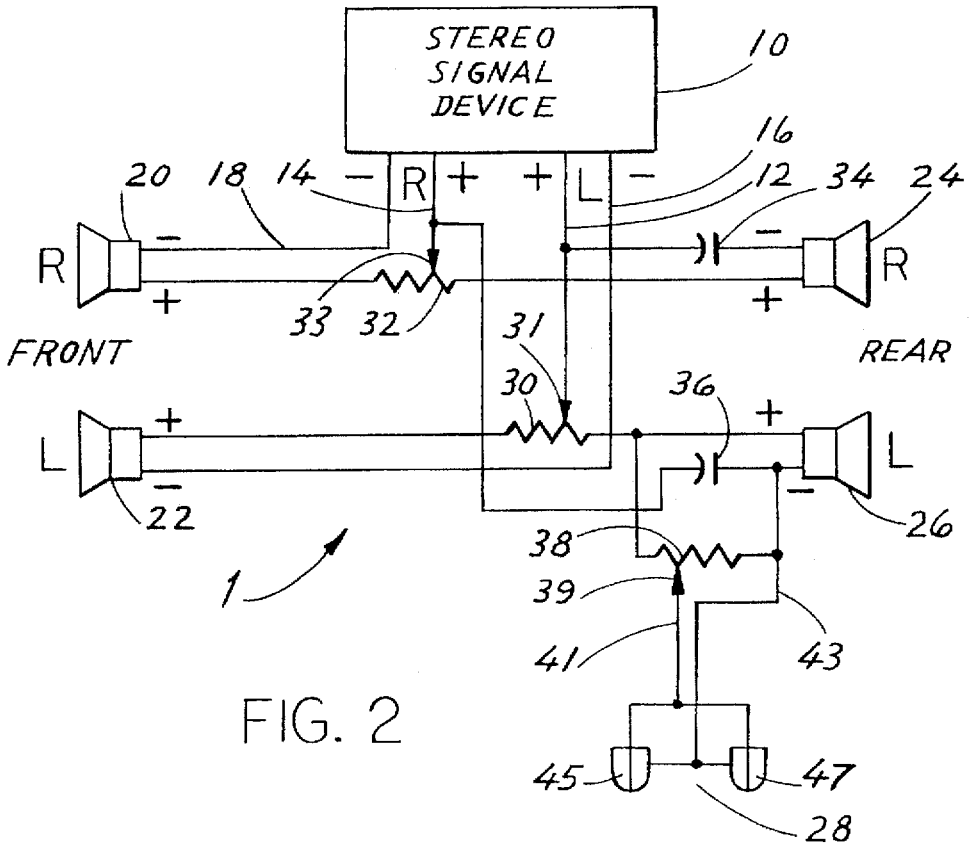
FIG. 2 is a schematic diagram of a surround sound converter circuit for home audio systems in accordance with the present invention.

FIG. 2 shows a schematic diagram of a surround sound converter circuit for home audio systems 1. A stereo signal device 10 supplies a left audio signal positive 12, a right audio signal positive 14, a left audio signal negative 16, and a right audio signal negative 18. The stereo signal device 10 may be an audio amplifier, a stereo receiver, or any stereo signal device which outputs an amplified stereo signal. The surround sound converter for home audio systems 1 includes outputs for a left front speaker 22, a right front speaker 20, a left rear speaker 26, a right rear speaker 24, and an auxiliary output 28 to accommodate a rear auxiliary amplifier.

The left audio signal positive 12 is connected to a wiper 31 of a left potentiometer 30. Adjustment of the left potentiometer 30 controls the volume balance between the left front speaker 22 and left rear speaker 26. The right audio signal positive 14 is connected to a wiper 33 of a left potentiometer 32. Adjustment of the right potentiometer 32 controls the volume balance between the right front speaker 20 and right rear speaker 24. One end of a right capacitor 34 is connected to the left audio signal positive 12 and the other end is used as a negative output terminal for the right rear speaker 24. One end of a left capacitor 36 is connected to the right audio signal positive 14 and the other end is used as a negative output terminal for the left rear speaker 26.

Adjustment of the wiper 33 of the left potentiometer 32 to the limit of adjustment thereof and the wiper 31 of the right potentiometer 30 to the limit of adjustment will produce the best surround sound image. Using a rear auxiliary amplifier to drive the rear speakers in conjunction with the above adjustment of the potentiometers will produce an even greater surround sound effect. The surround sound effect is created from the difference between the left and right channels or the out-of-phase signal of the left and right channels.

The surround sound converter for home audio systems 1 will also work without the left potentiometer 30 and the right potentiometer 32. The right audio signal positive 14 is connected to the right front speaker 20 and the right rear speaker 24. The left audio signal positive 12 is connected to the left front speaker 22 and left right rear speaker 26.

An output potentiometer 38 is placed across output terminals for the left rear speaker 26. The auxiliary output 28 allows the user to power the left rear speaker 26 and the right rear speaker 24 with a rear auxiliary amplifier. A wiper 39 of the output potentiometer 38 supplies a left output jack 45 and a right output jack 47 of the auxiliary output 28 with a surround sound signal 41. The negative output terminal for the left rear speaker 26 provides the left output jack 45 and right output jack 47 with an audio ground 43. The output potentiometer 38 may also be placed across output terminals for the right rear speaker 24. Alternatively, a left and right output potentiometer may be connected to the output terminals for the left rear speaker 26 and the right rear speaker 24, respectively. The output potentiometer 38 controls the voltage level input into the rear auxiliary amplifier.

Preferred values are given for the following elements as example, and not by way of limitation. A satisfactory value for the left capacitor 36 is 100 microfarads. A satisfactory value for the right capacitor 34 is 100 microfarads. A satisfactory value for the left potentiometer 30 is 25 ohms. A satisfactory value for the right potentiometer 32 is 25 ohms. A satisfactory value for the output potentiometer is 75 kilohms.

Figure 3:
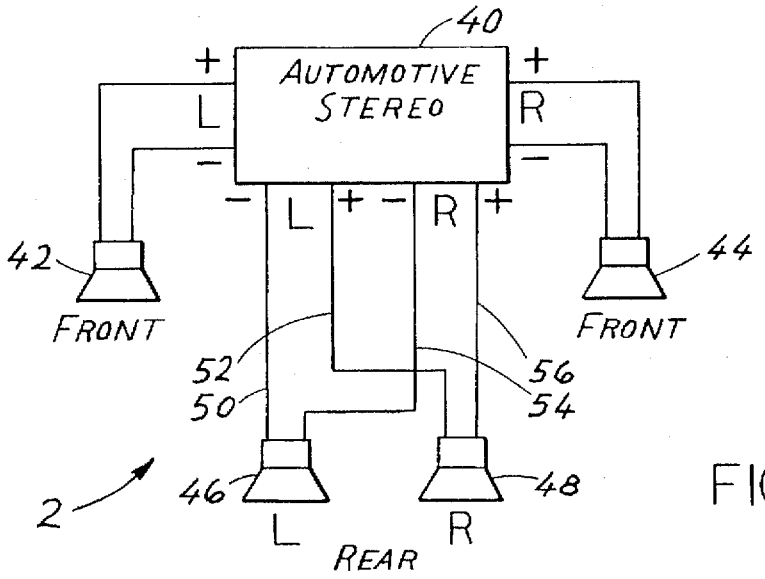
FIG. 3 is a schematic diagram of a surround sound converter circuit for vehicle audio systems in accordance with the present invention.

FIG. 3 shows a schematic diagram of a surround sound converter for vehicle audio systems 2. A surround sound converter for vehicle audio systems 2 utilizes an automotive stereo 40. The automotive stereo may be a radio, a radio/CD combination, a radio/cassette combination, or a radio/cassette/CD combination. A left front speaker 42 and a right front speaker 44 are connected to the normal speaker outputs of the automotive stereo 40. The left rear speaker 46 is connected to the left rear signal negative 50 and the right rear signal negative 54. The right rear speaker 48 is connected to the right rear signal positive 56 and the left rear signal positive 52. This unique method of connecting the rear speakers produces a three dimensional surround sound image. The balance between the front and rear speakers is controlled by the fader in the automotive stereo 40. It is also possible to use the unique method of connection on the front speakers and connect the rear speakers normally to achieve surround sound imaging.

Figure 4:
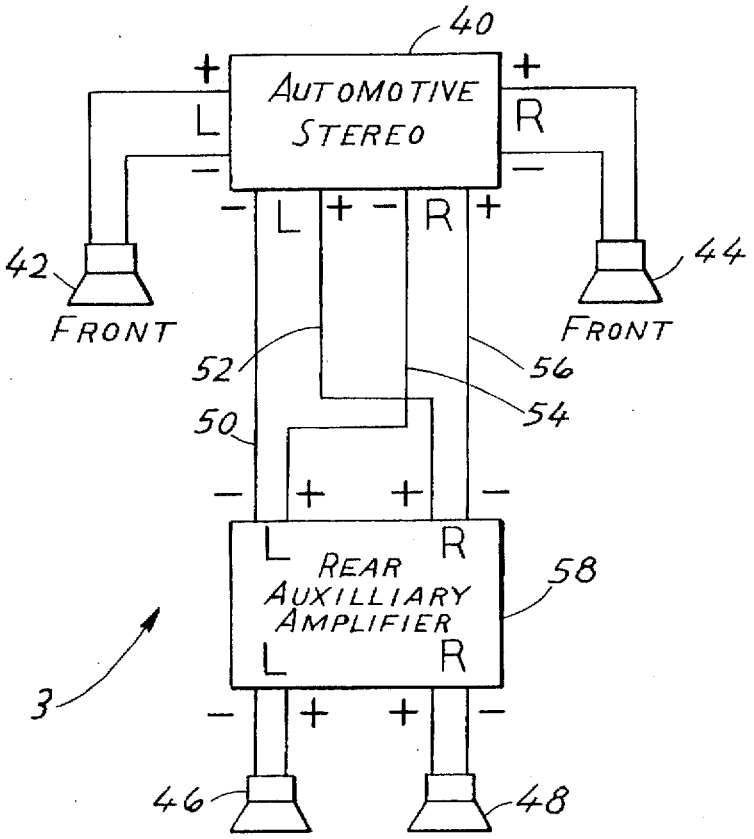
FIG. 4 is a schematic diagram of a surround sound converter circuit for vehicle audio systems with a rear auxiliary amplifier for powering rear speakers in accordance with the present invention.

FIG. 4 shows a schematic diagram of a surround sound converter for vehicle audio systems 3 with a rear auxiliary amplifier 58 for powering the rear speakers. The surround sound converter for vehicle audio systems 3 utilizes an automotive stereo 40 and a rear auxiliary amplifier 58. The left rear signal negative 50 and the right rear signal negative 56 are connected to the left audio signal input of the rear auxiliary amplifier 58. The left rear signal positive 52 and the right rear signal positive 54 are connected to the right audio signal input of the rear auxiliary amplifier 58. The left rear speaker 46 is connected to the left speaker output of the rear auxiliary amplifier 58 in a normal configuration. The right rear speaker 48 is connected to the right speaker output of the rear auxiliary amplifier 58 in a normal configuration. The balance between front and rear speakers is controlled by the use of the fader in the automotive stereo 40. It is also possible to connect the rear auxiliary amplifier 58 to the front speaker outputs of the automotive stereo 40 with the unique method of connection and connect the rear speakers normally to achieve surround sound imaging.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A surround sound converter comprising:

a right audio signal positive input;

a right audio signal negative input, said right audio signal positive input and said right audio signal negative input driving a right front speaker;

a left audio signal positive input;

a left audio signal positive input, said left audio signal positive input and said left audio signal negative input driving a left front speaker;

a left capacitor being connected to said right audio signal positive input, said left capacitor and said left audio signal positive input driving a left rear speaker; and a right capacitor being connected to said left audio signal positive input, said right capacitor and said right audio signal positive input driving a right rear speaker.

2. A surround sound converter of claim 1, further comprising:

a left potentiometer having a wiper, said wiper of said left potentiometer being connected to said left audio signal positive, said left potentiometer being connected to a positive output terminal for the left front speaker and a positive terminal of the left rear speaker, wherein the adjustment of said left potentiometer controlling the volume balance between said left front speaker and said left rear speaker; and a right potentiometer having a wiper, said wiper of said right potentiometer being connected to said right audio signal positive, said right potentiometer being connected to a positive output terminal for the right front speaker and a positive output terminal for the right rear speaker, wherein the adjustment of said right potentiometer controlling the volume balance between said right front speaker and said right rear speaker.

3. A surround sound converter of claim 1, further comprising:

an auxiliary output having an output potentiometer;

said output potentiometer having a wiper, said output potentiometer being connected to an output terminal for the left rear speaker, said wiper providing said auxiliary output with a surround sound signal; and a negative output terminal for the left rear speakers being connected to a ground of said auxiliary output.

4. A surround sound converter of claim 1, further comprising:

an auxiliary output having an output potentiometer;

said output potentiometer having a wiper, said output potentiometer being connected to an output terminal of the right rear speaker, said wiper providing said auxiliary output with a surround sound signal; and a negative output terminal for the right rear speaker being connected to a ground of said auxiliary output.

5. A surround sound converter of claim 1, further comprising:

an auxiliary output having a left output potentiometer and a right output potentiometer;

said left output potentiometer having a wiper, said left output potentiometer being connected to an output terminal for the left rear speaker, said wiper of said left output potentiometer providing a left output jack of said auxiliary output with a left surround sound signal;

a negative output terminal for the left rear speaker being connected to an audio ground of said left output jack;

said right output potentiometer having a wiper, said right output potentiometer being connected to an output terminal for the right rear speaker, said wiper of said right output potentiometer providing a right output jack of said auxiliary output with a right surround sound signal; and a negative output terminal for the right rear speaker being connected to an audio ground of said right output jack.

* * * * *